United States Patent [19]

Hupfer

[11] Patent Number: 4,709,556

[45] Date of Patent: Dec. 1, 1987

[54] HEAT EXCHANGER TUBE RETAINER FOR A REFRIGERATOR CONDENSER

[75] Inventor: Ronald K. Hupfer, Knight Township, Vanderburgh County, Ind.

[73] Assignee: Whirlpool Corporation, Benton Harbor, Mich.

[21] Appl. No.: 931,624

[22] Filed: Nov. 17, 1986

[51] Int. Cl.[4] ..... F25D 19/00; F16L 3/22

[52] U.S. Cl. ..... 62/298; 248/68.1; 248/73; 165/76; 165/162

[58] Field of Search ..... 248/68.1, 73, 74; 62/298; 165/76, 79, 162

[56] References Cited

U.S. PATENT DOCUMENTS 1,802,964 4/1931 Brady .
2,517,411 8/1950 Patterson .
2,729,412 1/1956 Amesbury .
3,363,864 1/1968 Olgreen ..... 248/68.1
3,680,818 8/1972 Bujnowski et al. .
3,806,994 4/1974 Lankford .
4,108,408 8/1978 Butti .

FOREIGN PATENT DOCUMENTS 2921891 12/1980 Fed. Rep. of Germany ..... 248/73

*Primary Examiner*—Henry A. Bennett
*Attorney, Agent, or Firm*—Wood, Dalton, Phillips, Mason & Rowe

[57] ABSTRACT

A retainer clip is provided for maintaining the relative relationship of tube portions in a condensing system. The condensing system for which use of the inventive clip is contemplated comprises first and second tube portions extending in spaced, substantially parallel relationship and a third tube portion extending transversely to the first and second tube portions. The clip is engaged with and turned relative to the first and second tube portions to effect assembly of one portion of the clip. Another portion of the clip is snap-fit to the third tube portion and thereby prevents disassembly of the one clip portion.

18 Claims, 9 Drawing Figures

FIG. 1
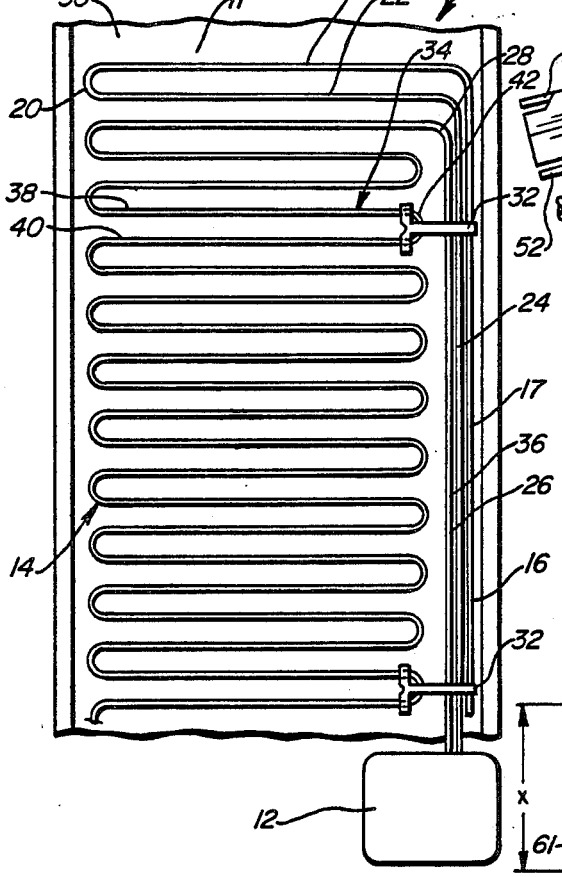
FIG. 2
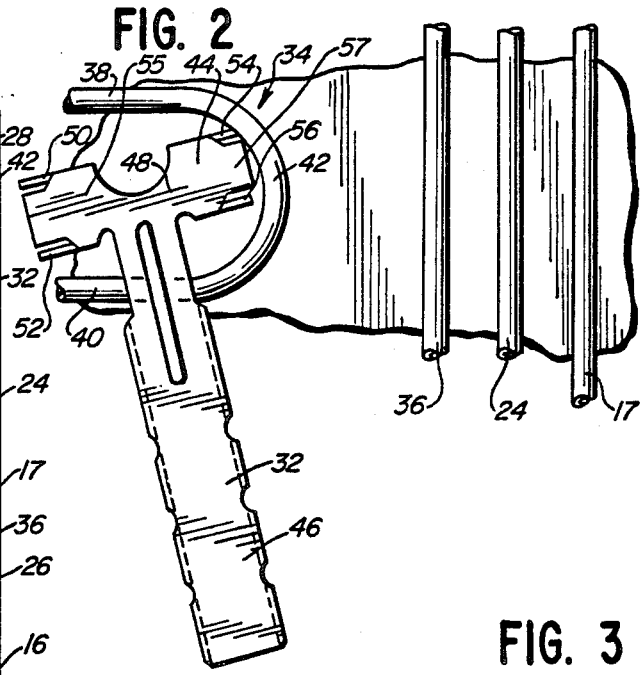
FIG. 3
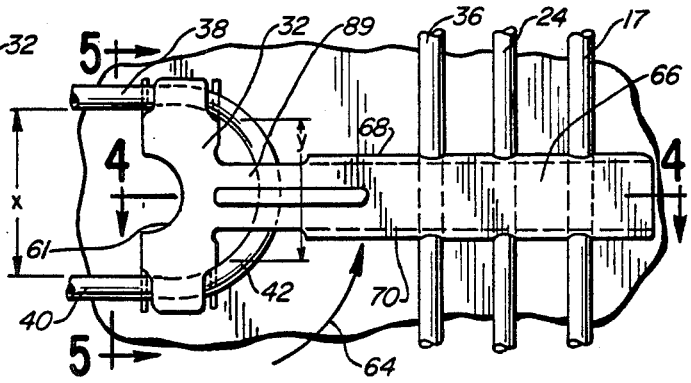
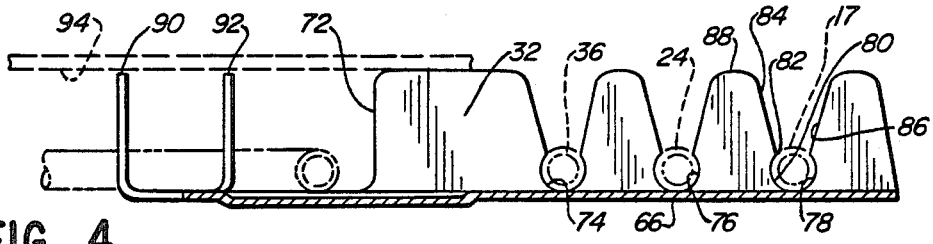
FIG. 4
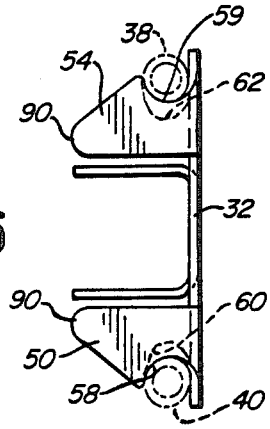
FIG. 5

FIG. 6
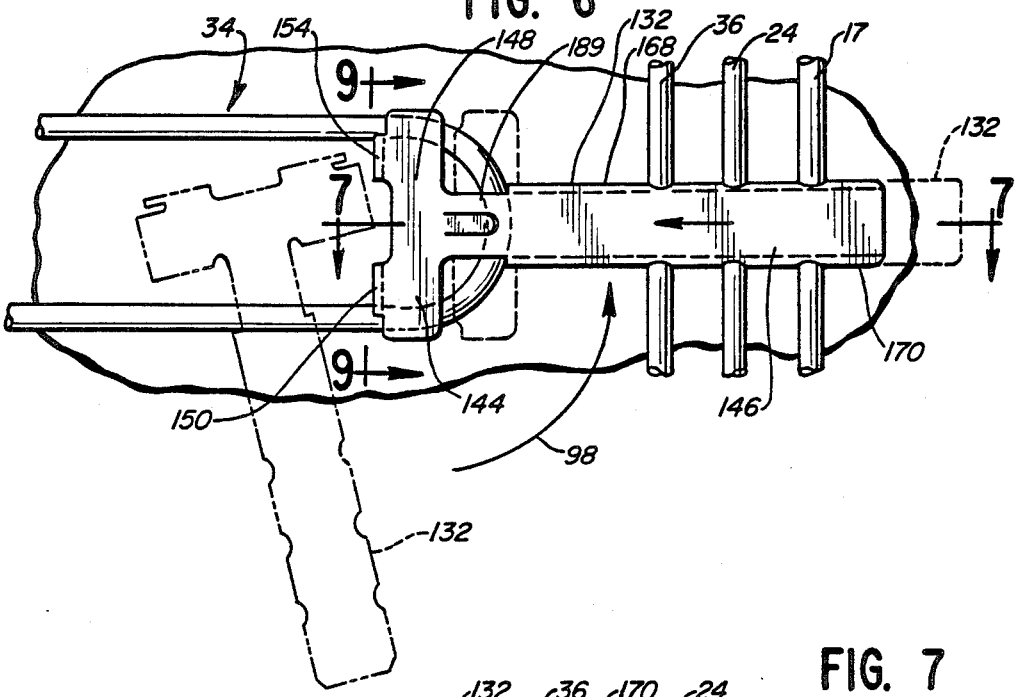
FIG. 7
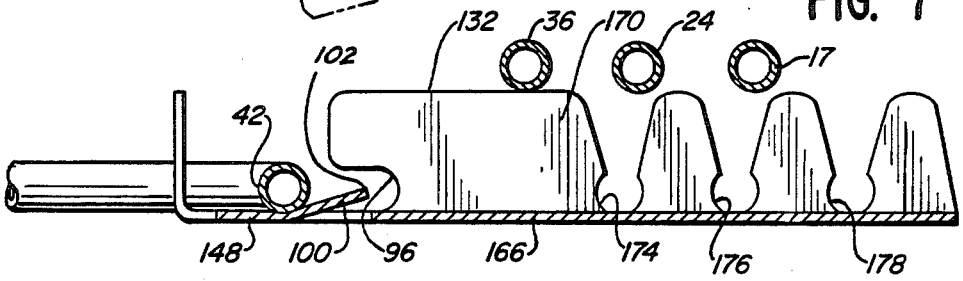
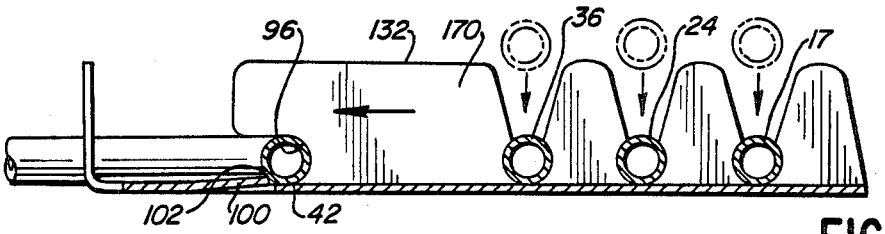
FIG. 8
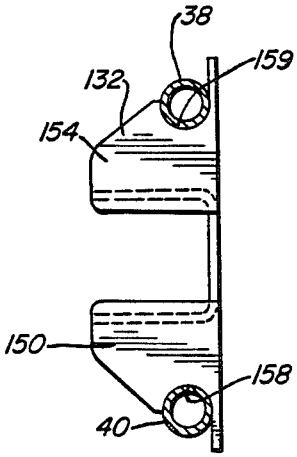
FIG. 9

HEAT EXCHANGER TUBE RETAINER FOR A REFRIGERATOR CONDENSER

BACKGROUND OF THE INVENTION

1. Field of the Invention

This invention relates to refrigeration apparatus and, more particularly, to a retainer clip for maintaining condensing tubes on the refrigeration apparatus in substantially fixed relationship relative to each other and the refrigeration cabinet.

2. Background Art

In refrigeration apparatus having a compressor, a compressed refrigerant is delivered to a condensing system through which heat is dissipated. A typical condensing system comprises a tube bank with one or more tubes arranged in a circuitous path and exposed at the rear wall of the refrigeration cabinet.

One problem with this style or refrigeration apparatus is that the tube bank tends to vibrate as the unit operates. Excessive vibration may cause damage to the tubes and/or the compressor from which the tubes emanate. In many prior art apparatus, the tube bank is collapsible towards the rear wall of the cabinet so as to compact the unit and prevent damage to the tube bank as for example when the unit is being stored and/or shipped. This collapsible feature precludes rigid attachment of the tube bank to the rear wall of the cabinet to control vibrations.

As an alternative to preassembly, on site rigid connection of the tube bank might be carried out, however this procedure is time consuming and quite complicated with known prior art structures.

SUMMARY OF THE INVENTION

The present invention is specifically directed to overcoming the above enumerated problems in a novel and simple manner.

According to the invention, a retainer clip is provided for maintaining the relative relationship of a plurality of tube portions in a condensing system. The condensing system for which use of the inventive clip is contemplated comprises first and second tube portions extending in spaced, substantially parallel relationship and a third tube portion extending transversely to the first and second tube portions.

The retainer clip comprises a first clip portion with oppositely opening U-shaped seats. To effect assembly with the first and second tube portions, the first clip portion is oriented between the first and second tube portions and turned so that the first and second tube portions simultaneously move into the seats. Relative movement of the clip and tube portions is thereby restricted in all but a direction lengthwise of the first and second tube portions.

The clip has a second portion which engages the third tube portion. With the second clip portion connected to the third tube portion, relative shifting of the clip lengthwise of the first and second tube portions is prohibited and at the same time turning of the first clip portion relative to the first and second tube portions, as might release the first clip portion from the first and second tube portions, is prohibited. In a preferred form, the second clip portion is removably snap-fit to the third tube portion. In a typical refrigeration apparatus, three tubes extend transversely to the first and second tube portions. The clip cooperates with the first and second tube portions and three transverse tube portions to minimize vibration and rigidify the connection therebetween. At the same time the clip maintains a predetermined spacing of the tube bank from the rear wall of the cabinet.

The clip is capable of formation using a single blank of sheet metal material.

In one embodiment of the invention, a deflectable tab is associated with the first clip portion and upon the clip realizing an assembled orientation the tab blocks shifting of the clip lengthwise relative to the first and second tube portions. Disassembly of the first clip portion from the tube bank requires that the tab be manually deflected from its locked position.

With the present invention, on site assembly of the clips can be readily accomplished. The retainer clip is simple and inexpensive to manufacture.

BRIEF DESCRIPTION OF THE DRAWINGS

FIG. 1 is a rear elevation view of the condensing system for a refrigeration apparatus with retainer clips according to the present invention attached;

FIG. 2 is a rear elevation view of a portion of the condensing system with the retainer clip in a first orientation to initiate connection thereof;

FIG. 3 is a view as in FIG. 2 with the clip in assembled relationship with the condensing system;

FIG. 4 is a sectional view of the assembled clip along line 4—4 of FIG. 3;

FIG. 5 is a sectional view of the assembled clip along line 5—5 of FIG. 3;

FIG. 6 is a rear elevation view of the condensing system with a modified clip according to the present invention attached;

FIG. 7 is a sectional view of the modified clip along line 7—7 of FIG. 6 with the clip partially assembled;

FIG. 8 is a view as in FIG. 7 with the clip in its fully assembled position; and FIG. 9 is a sectional view of the assembled clip along line 9—9 of FIG. 6.

DETAILED DESCRIPTION OF THE DRAWINGS

In FIG. 1 a refrigeration apparatus suitable for incorporation of the present invention is shown at 10. The refrigeration apparatus 10 has a cabinet containing a compressor 12, for a refrigerant, which transverses a tube bank at 14 at the rear of the cabinet 11 so that the heat from the refrigerant is dissipated to the atmosphere.

The tube bank 14 comprises a first tube or conduit 16, which has a vertical portion 17 turning into a laterally extending portion 18 adjacent the upper region of the cabinet 11. The tube 16 has a return bend 20 and a second laterally extending portion 22 which is substantially parallel to the first portion 18. The second portion 22 bends downwardly and a vertical portion 24 extends therefrom to the compressor 12.

A second tube 26 extends vertically from the compressor 12, has a bend 28 beneath the second laterally extending portion 22 and from there the tube follows a serpentine path towards the bottom of the apparatus 10.

To maximize heat dissipation, the tube bank 14 is exposed a slight distance behind the rear wall 30 of the cabinet 11. Because the tube bank 14 is obtrusive and can be easily damaged as the unit is handled, provision is often made in conventional apparatus to collapse the tube bank 14 against the rear wall 30 of the apparatus.

With the tube bank 14 moved away from the rear wall 30 to its operative position, there is a tendency of the unsupported tube bank to vibrate during operation.

The present invention is directed to structure for maintaining the relative relationship between the laterally extending tube portions, the vertically extending tube portions and the rear wall of the cabinet 11 to thereby minimize vibration of the tube bank 14.

For purposes of understanding the invention, one inventive retainer clip 32 will be described with respect to an upper portion of the tube bank. The upper clip 32 in FIG. 1 connects one U-shaped section at 34 with the vertically extending tube portions 17 and 24 on the first tube 16 and the vertical section 36 on the second tube 26. The U-shaped section 34 comprises a first horizontal tube portion 38, a second horizontal tube portion 40, spaced from and substantially parallel to the tube portion 38, and a curved base 42 interconnecting them tube portions 38, 40.

The details of the retaining clip 32 and the connection between the clip 32 and the U-shaped tube bank section 34 and vertical tube portions 17, 24, 36 are shown in FIGS. 2–5. The clip 32 takes a generally T-shaped configuration and comprises a first portion 44 for connection to the U-shaped section 34 and a second portion 46 for connection to the vertically extending tube portions 17, 24, 36. The clip is preferably formed from a single sheet of spring type sheet metal material.

The first clip portion 44 comprises a flat body 48 with flanges 50, 52, 54, 56 integral with and bent out of the body at right angles thereto so as to define a U-shape in conjunction with the body 48. The flanges 50, 52 are carried on one half 55 of the body 48 and the flanges 54, 56 are carried separately on the other half 57 of the body 48. The body 48 has a semi-circular cut-out 61 between the halves 55, 57, to thereby allow relative flexing between the body halves 55, 57.

The flanges 50, 54 have oppositely opening U-shaped seats 58, 59 respectively. The spacing between the base of seats 58, 59 is approximately equal to the distance X (FIG. 3) between the tube portions 38, 40.

The flanges 52, 56 have oppositely opening U-shaped seats 60, 62 respectively. The spacing between the base of the seats 60, 62 is approximately equal to the distance Y representing the spacing between the tube portions 38, 40 adjacent the base 42 where the flanges 52, 56 are to be positioned, as in FIG. 3 with the clip assembled.

The first clip portion 44 is assembled to the U-shaped tube section 34 by positioning the clip 32 as in FIG. 2 with the first clip portion between the tube portions 38, 40 and with the length of the body 48 of the clip at an angle to the length of the tube portions 38, 40. With the clip so situated, the axes of the seats 58, 59, 60, 62 align with the plane of the central axis of the U-shaped section 34. By turning the clip 32 in the direction of arrow 64, i.e. counterclockwise in FIG. 3, the tube portions 38, 40 move simultaneously into the seats 58, 59 and 60, 62 respectively. With the clip situated as in FIG. 3, shifting of the clip transversely to the plane of the central axis of the U-shaped section 34 is prohibited. The bend 42 interferes with the flanges 52, 56 to limit shifting of the clip lengthwise of the U-shaped section towards the bend 42. The position where this interference occurs depends on the depth of seats 60, 62.

The second clip portion comprises a flat body 66 with flanges 68, 70 bent from the body at right angles thereto so as to define a U-shaped in conjunction with the body 66. A space 72 is maintained between the flanges 68, 70 and the first clip portion to allow repositioning of the clip from its FIG. 2 orientation to that in FIG. 3 without interference between the clip 32 and U-shaped section 34. The flanges 68, 70 each have spaced seats 74, 76, 78 which are spaced from each other lengthwise of the body 66 a distance corresponding to the spacing of tube portions 17, 24, 36. The seats 74, 76, 78 are similarly configured and thus description will be limited to one such seat, 78.

The seat 78 comprises a circular seat portion 80 with the bottom thereof bounded by the body 66. A restricted entryway 82, of slightly lesser diameter than the diameter of the tube portions 17, 24, 36, allows the tube portions 17, 24, 36 to be press-fit into and maintained in the seat. Walls 84, 86 converge from the free edges 88 of flanges 68, 70 towards the seat 78 and guide the tube 17 into its seated position. Because the flanges 68, 70 are interrupted by the seats 74, 76, 78, the body is free to flex to enlarge the restricted entryway 82 upon the second clip portion being engaged with the tube portion 17. With the first clip portion connected and oriented as in FIG. 3, the seats 74, 76, 78 align directly over the tube portions 36, 24, 17 consecutively. To secure the second clip portion to the tubes, the second clip portion is pressed against first tube portion 36 and then portions 24 and 17 until all three tube portions are appropriately seated.

As shown in FIG. 4, preferably the centers of the seats 74, 76, 78 align in the plane of the central axis of the U-shaped section 34. Movement of the clip from the FIG. 2 orientation to that in FIG. 3 is permitted without interference between the second clip portion and the tube portions 17, 24, 36 by reason of the provision of a flexible portion 89 interconnecting the first and second clip portions. The clip portion 89 allows the second clip portion to be deflected away from the rear wall of the refrigeration apparatus so that the flanges 68, 70 clear the tube sections 17, 24, 36 as the clip is reoriented. The tube bank 14 has some inherent flexibility and this also facilitates reorientation of the clip.

With the clip in its assembled position, the free edges 90 of the flanges 50, 54, free edges 92 of flanges 52, 56 and free edges 88 of the flanges 58, 70 abut the rearwardly facing surface 94 of the rear wall 30 of the cabinet 11. Thus the clip, besides maintaining the relative positions of the tube section 34 and tube portions 17, 24, 36, maintains the tube bank spaced a predetermined amount from the rear wall 30 and thereby braces the tube bank.

In FIGS. 6–9, an alternative embodiment of the clip according to the invention is shown for connection of the tube section 34 and tube portions 17, 24, 36. The clip 132 in FIGS. 6–9 has a first portion 144 and second portion 146 corresponding to those of the prior embodiment. The second portion 146 has a body 166 with flanges 168, 170 extending at right angles thereto and defining seats 174, 176, 178 for reception of tube portions 17, 24, 36.

The first clip portion 144 has a body 148 with flanges 150, 154 corresponding to flanges 50, 54 respectively in the prior embodiment. The flanges 150, 154 define oppositely opening U-shaped seats 158, 159 for reception of tube portions 40, 38 respectively, as in the prior embodiment. Each of flanges 168, 170 has a U-shaped seat 96 opening toward the flanges 150, 154.

Assembly of the clip 132 is accomplished in a manner similar to that used to assemble clip 32. The clip 132 is positioned as shown in phantom at the left side in FIG.

6 and rotated in the direction of arrow 98 to the position shown in solid lines in FIG. 6. To fully seat the clip, the clip is drawn from its solid line position in FIG. 6 toward the right to the fully seated position shown in phantom. This transition is shown between FIG. 7 and FIG. 8, with the bend 42 being positioned closely in the seats 96 associated with flanges 168, 170 in FIG. 8.

A deflectable tab 100 is struck from the clip portion 189 between the first and second clip portions. As the clip is moved from the solid line position in FIGS. 6 and 7, the base 42 deflects the tab back toward the body 166 of the clip. Upon the base 42 being fully positioned in seats 96, the tab 100 springs back slightly so as to bring a corner 102 thereof against the base 42 to block the base 42 in the seats 96. The tube portions 17, 24, 36 are press-fit into the seats 174, 176, 178 as shown in FIG. 8 to complete assembly of the retainer clip.

If it is desired to disassemble the clip, the second clip portion is first unsnapped from the tube portions 17, 24, 36. Thereafter, the tab 100 is deflected away from the base 42 sufficiently that the base can be drawn out of the seats 96. The clip can then be turned to effect release. Alternatively, the clip can be slid lengthwise of the tube section 34 away from the base 42 and thereafter turned.

It should be understood that the foregoing detailed description was made for purposes of describing the inventive structure and operation thereof, with no unnecessary limitations to be understood therefrom.

I claim:

1. In a refrigeration apparatus having fluid conducting tube means including first and second spaced side by side portions and a third portion extending transversely to said first and second portions, the axes of said tube means portions defining a common plane, means for rigidifying the tube means comprising:

retaining means defining a pair of outwardly oppositely opening seats spaced apart a distance substantially equal to the spacing between said first and second tube means portions, said first and second tube means portions being received one each in said seats to be constrained thereby against relative movement angularly to said common plane and movement toward each other; and securing means associated with said retaining means and removably secured to said third tube means portion for preventing movement of said retaining means toward and from said third tube means portion.

2. The refrigeration apparatus structure according to claim 1 wherein said retaining means and said securing means comprise a clip formed of sheet material.

3. The refrigeration apparatus structure according to claim 1 further including means for spacing said common plane a preselected distance from a second plane extending parallel to said common plane.

4. The refrigeration apparatus structure according to claim 1 further including means for mounting the first, second and third portions in a single common plane.

5. A retainer clip for use with a refrigeration apparatus of the type having a condensing system with a tube bank having first and second tube portions extending in spaced, substantially parallel relationship and a third tube portion extending transversely to the first and second tube portions, said retainer clip comprising:

a first clip portion;

means for removably securing the first clip portion to the first and second tube portions upon the first clip portion being engaged with and turned relative to the first and second tube portions;

a second clip portion; and means for removably connecting the second clip portion to the third tube portion so that the first clip portion cannot be turned relative to the first and second tube portions with the second portion of the clip connected to the third tube portion, whereby with the first clip portion secured to the first and second tube portions and the second clip portion connected to the third tube portion the first, second and third tube portions are maintained in substantially fixed relative relationship and the first clip portion cannot be separated from the first and second tube portions without first disconnecting the second clip portion from the third tube portion.

6. The retainer clip according to claim 5 wherein said first clip portion has first and second U-shaped seats opening in opposite directions and the first clip portion is secured to the first and second tube portions by aligning the first and second U-shaped seats between the first and second tube portions and turning the first clip portion in a first direction relative to the first and second tube portions so that the first and second tube portions simultaneously move into the first and second U-shaped seats.

7. The retainer clip according to claim 5 wherein the means for removably connecting the second portion of the clip to the third tube portion comprises means for removably snap-fitting the second clip portion to the third tube portion.

8. The retainer clip according to claim 5 wherein said clip is formed as a single piece.

9. The retainer clip according to claim 5 wherein said clip is formed from a single blank of sheet metal material.

10. The retainer clip according to claim 5 wherein the means for removably connecting the second portion of the clip comprises a seat in the second clip portion with a restricted entryway in communication with the seat, whereby the third tube portion can be pressed through the restricted entryway and removably located in the seat in the second clip portion.

11. A retainer clip for use with a refrigeration apparatus of the type having a condensing system with a tube bank having a U-shaped tube section with a base and first and second tube portions extending from the base in spaced, substantially parallel relationship, and a third tube portion having an axis residing within a plane extending through the central axis of the U-shaped tube section, said retainer clip comprising:

a first clip portion having first and second, spaced oppositely opening, U-shaped seats for accepting the first and second tube portions, said seats being spaced so that the first clip portion can be placed between the first and second tube portions with the first clip portion in a first orientation and upon turning the first clip portion relative to the first and second tube portions from the first orientation, the first and second tube portions can be brought simultaneously into the first and second seats with the first clip portion in a second orientation;

means for retaining said first and second tube portions in the first and second seats;

a second clip portion; and means for connecting the second clip portion to the third tube portion with the first clip portion secured to the first and second tube portions so that the first clip portion cannot be turned relative to the first and second tube portions with the second portion of the clip connected to the third tube portion;

there being a space between said first and second clip portion to allow passage of the base of the tube section so that the base of the tube section does not interfere with the retainer clip as the first clip portion is moved from said first orientation to said second orientation, whereby with the first clip portion secured to the first and second tube portions and the second clip portion connected to the third tube portion the first, second and third tube portions are maintained in substantially fixed relative relationship and the first clip portion cannot be separated from the first and second tube portions without first disconnecting the second clip portion from the third tube portion.

12. The retainer clip according to claim 11 wherein said means for retaining comprises a deflectable tab which locks the first and second tube portions in the first and second seats upon the first clip portion realizing said second orientation.

13. The retainer clip according to claim 11 wherein the means for connecting the second clip portion to the third tube portion comprises a seat in the second clip portion with a restricted entryway in communication with the seat, whereby the third tube portion can be pressed through the restricted entryway and removably located in the seat in the second clip portion.

14. The retainer clip according to claim 11 wherein the means for connecting the second clip portion to the third tube portion comprises a seat in the second clip portion with a restricted entryway in communication with the seat, whereby the third tube portion can be pressed through the restricted entryway and removably located in the seat in the second clip portion and the seat in the first and second clip portion open at approximately 90° to each other.

15. The retainer clip according to claim 11 wherein said second clip portion comprises a body with first and second offset flanges and there is a seat in each of said flanges and said third tube portion can be seated in the seats in the first and second offset flanges.

16. The retainer clip according to claim 11 wherein the first clip portion comprises a body with first and second pairs of offset flanges and each flange in each of the first and second pairs of flanges has an opening defining said oppositely opening U-shaped seats, whereby the openings in each flange pair cooperatively accept the first and second tube portions.

17. The retainer clip according to claim 11 wherein said clip is formed from a single blank of sheet metal material.

18. The retainer clip according to claim 11 wherein said refrigeration apparatus has a rear wall and means are provided on the clip for bearing against the rear wall to space the first, second and third tube portions a predetermined distance from said rear wall.

* * * * *